US007896463B2

(12) United States Patent
Nakagawa et al.

(10) Patent No.: US 7,896,463 B2
(45) Date of Patent: Mar. 1, 2011

(54) INK JET PRINTING APPARATUS AND PRELIMINARY EJECTING METHOD

(75) Inventors: Yoshinori Nakagawa, Kanagawa (JP); Osamu Iwasaki, Tokyo (JP); Satoshi Seki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 695 days.

(21) Appl. No.: 11/767,231

(22) Filed: Jun. 22, 2007

(65) Prior Publication Data

US 2007/0236534 A1 Oct. 11, 2007

Related U.S. Application Data

(62) Division of application No. 10/649,640, filed on Aug. 28, 2003, now abandoned.

(30) Foreign Application Priority Data

Aug. 30, 2002 (JP) ..... 2002-255900

(51) Int. Cl.
*B41J 2/165* (2006.01)

(52) U.S. Cl. ..... 347/35; 347/5; 347/28; 347/40

(58) Field of Classification Search ..... 347/5, 347/23–40, 43, 50
See application file for complete search history.

(56) References Cited

U.S. PATENT DOCUMENTS

| | | | | |
|---|---|---|---|---|
| 5,132,710 | A | 7/1992 | Ejiri et al. | 347/3 |
| 5,638,100 | A | 6/1997 | Kanematsu et al. | |
| 6,079,809 | A | 6/2000 | Yaegashi et al. | 347/35 |
| 6,257,696 | B1 | 7/2001 | Nakamura | 347/30 |
| 6,984,009 | B2 | 1/2006 | Nakagawa et al. | |
| 7,011,386 | B2 | 3/2006 | Iwasaki et al. | |
| 2001/0026723 | A1 * | 10/2001 | Otsuka et al. | 400/323 |
| 2001/0038400 | A1 | 11/2001 | Yamada et al. | |
| 2002/0005874 | A1 | 1/2002 | Imai et al. | |
| 2002/0024563 | A1 | 2/2002 | Koitabashi et al. | |
| 2002/0030716 | A1 | 3/2002 | Watanabe et al. | 347/43 |
| 2002/0113845 | A1 * | 8/2002 | Yazawa et al. | 347/65 |

FOREIGN PATENT DOCUMENTS

| | | |
|---|---|---|
| EP | 1 208 990 | 5/2002 |

* cited by examiner

*Primary Examiner*—Manish S Shah
(74) *Attorney, Agent, or Firm*—Fitzpatrick, Cella, Harper & Scinto

(57) ABSTRACT

The present invention provides an ink jet printing apparatus that can inexpensively print desired colors without causing ink color mixture. In a print head, a plurality of nozzle rows for respective ink colors are arranged in parallel with one another. Arrangements and driving control are provided so that few mists resulting from an ink ejecting operation move so as not to reach the print head or fall.

4 Claims, 9 Drawing Sheets

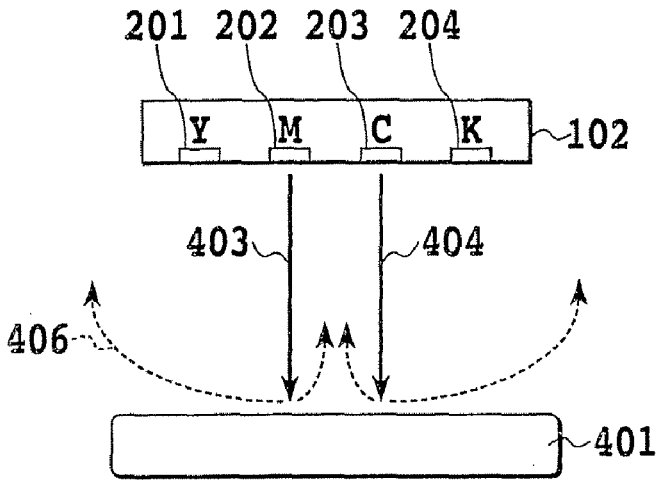
FIG.4A
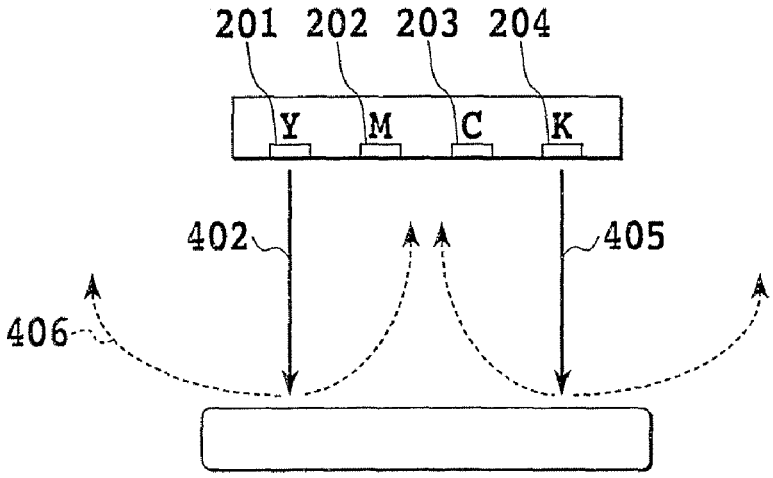
FIG.4B
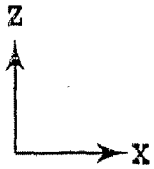

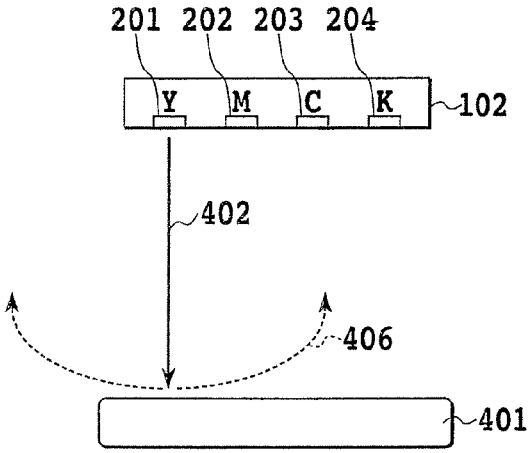
FIG.6A
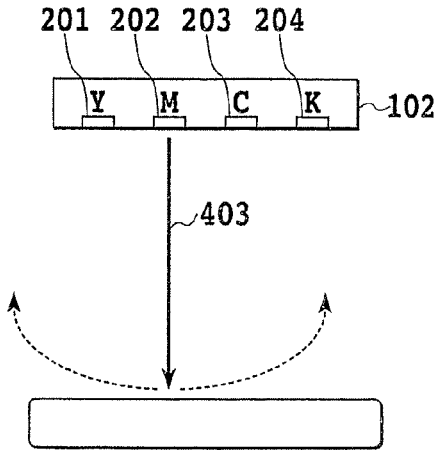
FIG.6B
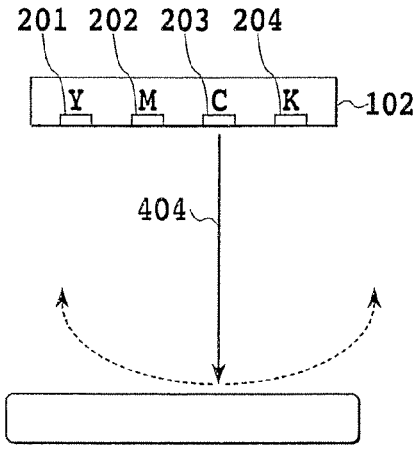
FIG.6C
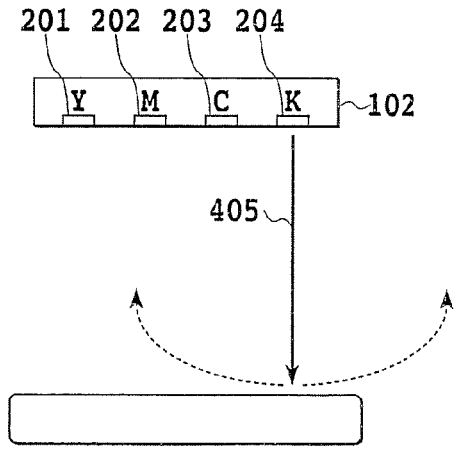
FIG.6D
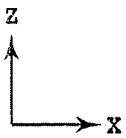

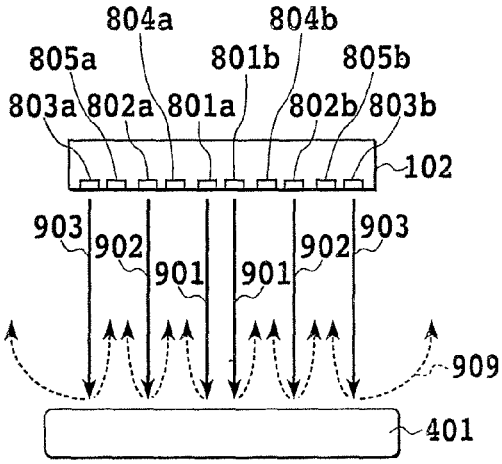
FIG.9A
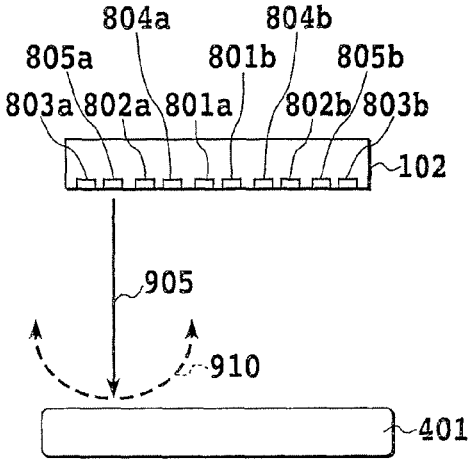
FIG.9B
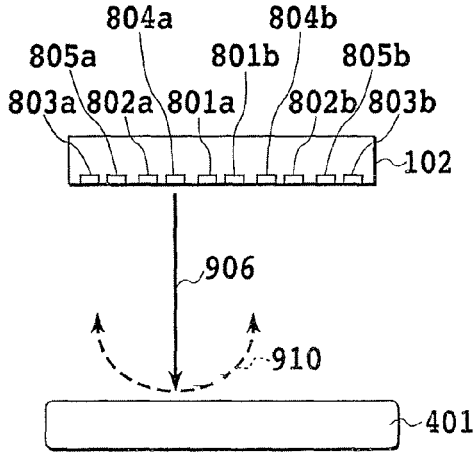
FIG.9C
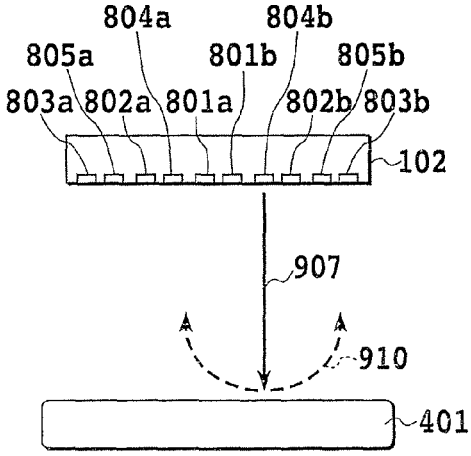
FIG.9D
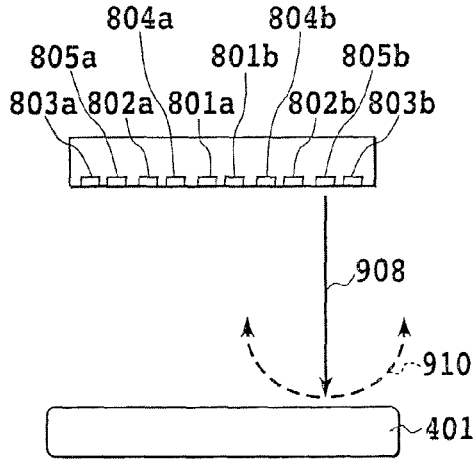
FIG.9E
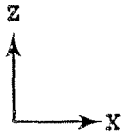

INK JET PRINTING APPARATUS AND PRELIMINARY EJECTING METHOD

This application is a division of U.S. patent application Ser. No. 10/649,640, filed Aug. 28, 2003.

This application claims priority from Japanese Patent Application No. 2002-255900 filed Aug. 30, 2002, which is incorporated hereinto by reference.

BACKGROUND OF THE INVENTION

1. Field of the Invention

The present invention relates to an ink jet printing apparatus that carries out printing by ejecting ink to a print medium. More specifically, the present invention relates to an ink jet printing apparatus that carries out preliminary ejection to recover the appropriate conditions of a print head as well as a preliminary ejecting method executed using this apparatus.

2. Description of the Related Art

Some printing apparatuses are used as means for printing images in a printer, a copier, a facsimile, or the like, or as print output equipment for composite electronic equipment, a workstation, or the like which includes a computer, a word processor, or the like. These printing apparatuses are configured to print images or the like on print media such as sheets or thin plastic sheets on the basis of image information (including all of output information such as text information). On the basis of their printing methods, these apparatuses can be classified into an ink jet type, a wire dot type, a thermal type, a laser beam type, and the like. Among them, an ink jet type printing apparatus (hereinafter referred to as an "ink jet printing apparatus") carries out printing by ejecting from printing means including a print head, to a print medium. This method easily increases definition compared to the other printing methods. Further, this printing apparatus has various advantages: it operates fast and silently and is inexpensive. On the other hand, in recent years, color outputs such as color images have become more and more important. Accordingly, a large number of color ink jet printing apparatuses have been developed which provide high quality images equivalent to silver photographs.

In order to improve a printing speed, such an ink jet printing apparatus comprises a print head in which a plurality of print elements are integrally arranged and in which a plurality of ink ejection openings and liquid channels are integrated together. Furthermore, the apparatus is generally provided with a plurality of such print head in order to deal with color printing.

As shown in FIG. 1, the ink jet printing apparatus often uses a serial type printing method of printing the entire print medium by repeating a printing operation of executing printing while scanning a print head from which ink is ejected, along a guide rail and a paper feeding operation of feeding paper by a predetermined amount.

FIG. 2 is a schematic view showing an ejection opening surface of a print head. Ejection opening rows are formed in a direction perpendicular to a scanning direction of the print head. Further, the ejection opening rows for the respective ink colors are arranged parallel with the scanning direction of the print head.

In each of the ink ejection openings constituting the print head, if no ejecting operations are performed for a specified time, ink present close to the ejection opening may become more viscous or dust floating in the air may stick to the vicinity of the ejection opening. Consequently, ejection may be inappropriately carried out: the amount of ink ejected or the direction of ejection may become unstable during an ejecting operation. Thus, preliminary ejection, a kind of a recovery process, is periodically executed, after no ejecting operations are performed for the specified time, before an ejecting operation is started or during a printing operation. This enables the removal of the more viscous ink or the dust or droplets attached to the vicinity of the ejection opening, together with ejected ink.

With the above described serial type printing method, the print head moves to a preliminary ejection receiver provided in an area different from a print area. Then, ink is ejected to the preliminary ejection receiver the predetermined number of times at a predetermined ejection frequency. The preliminary ejection receiver is provided at, for example, a position opposite to a print head 102 at its home position.

After ejection, an ink droplet ejected from the ejection opening is often divided into a plurality of pieces before flying. The plurality of ink droplets obtained by the division include main droplets that are the largest ink droplets, satellites that are ink droplets smaller than the main droplets, and mists that are ink droplets finer than the satellites and flying at a low speed. This phenomenon of course occurs not only during a printing operation but also during a preliminary ejecting operation.

FIGS. 3A to 3C illustrate how an ejected ink droplet is divided. In these figures, reference numerals 301, 302, and 303 denote ink, just ejected ink, and meniscus. Reference numerals 304, 305, and 306 denote a main droplet, a satellite, and a floating mist.

As shown in FIG. 3A, ejection is started. Immediately after the start of the ejection, the ink is continuously ejected from a nozzle. Subsequently, in FIG. 3B, the meniscus 303, which results from the contraction of bubbles or the deformation of a piezoelectric element, retreats to move the ink 301 to the interior of the print head 102. The movement of the ink 301 causes the ejected ink 302 to be separated from the ink present inside the print head. This creates a speed distribution in the ejected ink 302. In FIG. 3C, the ink with the speed distribution is divided. This results in an ink droplet with the largest volume and the highest speed (main droplet 304), ink droplets having a smaller volume and a lower speed than the main droplet (satellites 305), and ink droplets having a much smaller volume and a much lower speed and floating in the air without reaching the preliminary ejection receiver (floating mists 306).

If each color nozzle row in the print head 102 undergoes preliminary ejection and when all of the nozzle rows are simultaneously subjected to preliminary ejection, power required for preliminary ejection may exceed the maximum power supplied to the ink jet printing apparatus. In this case, the ejection cannot be correctly executed. In view of such a problem associated with supplied power, the preliminary ejection is often executed a plurality of times for each color nozzle row. However, when the ejection openings or ejection opening rows in each color nozzle row are divided into groups for preliminary ejection, a time difference in preliminary ejecting operation occurs between the ejection openings or the ejection opening rows. The present inventors have found that this results in a color mixture problem.

SUMMARY OF THE INVENTION

It is an object of the present invention to provide an ink jet printing apparatus that enables desired colors to be inexpensively printed without causing ink color mixture.

In the first aspect of the present invention, there is provided an ink jet printing apparatus that forms an image by ejecting ink from a print head in which a plurality of ejecting portion rows are arranged, to a print medium, each of the ejecting portion rows having a plurality of ejecting portions arranged in it, the apparatus comprising:

a carriage that scans a print head; and preliminary ejecting means for ejecting the ink from the ejecting portions in the print head so that the ejection is not involved in formation of the image, and wherein the preliminary ejecting means sequentially selects one of the plurality of ejecting portion rows as the ejecting portion on which an ejecting operation is performed, while the carriage is not performing a scanning operation, and the preliminary ejecting means then subjects the selected ejecting portion row to preliminary ejection.

In the second aspect of the present invention, there is provided an ink jet printing apparatus that forms an image by ejecting ink from a print head in which a plurality of ejecting portion rows are arranged, to a print medium, each of the ejecting portion rows having a plurality of ejecting portions arranged in it, the apparatus comprising:

(ejecting portion row arranging) means for arranging the plurality of ejecting portion rows at intervals of a predetermined distance set so that mists resulting from a preliminary ejecting operation performed on the plurality of ejecting portion rows do not reach a surface of the print head in which the plurality of ejecting portion rows are disposed.

In the third aspect of the present invention, there is provided an ink jet printing apparatus that forms an image by ejecting ink from a print head in which a plurality of ejecting portion rows are arranged, to a print medium, each of the ejecting portion rows having a plurality of ejecting portions arranged in it, the apparatus comprising:

a carriage that scans a print head; and preliminary ejecting means for ejecting the ink from the ejecting portions in the print head so that the ejection is not involved in formation of the image, and wherein the preliminary ejecting means selects a set of plural adjacent ones of the plurality of ejecting portion rows as the ejecting portions on which an ejecting operation is simultaneously performed, and switches the set to perform a preliminary ejecting operation for the plurality of ejecting portion rows sequentially.

In the fourth aspect of the present invention, ther is provided an ink jet printing apparatus comprising:

a print head including a plurality of large ejecting portion rows in which large ejecting portions are arranged from which a relatively large amount of ink is ejected during one ejecting operation and a plurality of small ejecting portion rows in which small ejecting portions are arranged from which a relatively small amount of ink is ejected during one ejecting operation, preliminary ejecting means for ejecting the ink from the ejecting portions in the print head so that the ejection is not involved in formation of an image, preliminary ejecting control means for simultaneously performing a preliminary ejecting operation on the plurality of large ejecting portion rows, and for performing a preliminary ejecting operation on the plurality of small ejecting portion rows one by one.

In the fifth aspect of the present invention, there is provided a preliminary ejecting method executed using an ink jet printing apparatus that forms an image by ejecting ink from a printhead in which a plurality of ejecting portion rows are arranged, to a print medium, each of the ejecting portion rows having a plurality of ejecting portions arranged in it, the ink being ejected from the ejecting portions in the print head so that the ejection is not involved in formation of the image, the method comprising:

a step of sequentially selecting one of the plurality of ejecting portion rows as the ejecting portion on which an ejecting operation is performed and then subjecting the selected ejecting portion row to preliminary ejection.

In the sixth aspect of the present invention, there is provided a preliminary ejecting method executed using an ink jet printing apparatus that forms an image by ejecting ink from a print head in which a plurality of ejecting portion rows are arranged, to a print medium, each of the ejecting portion rows having a plurality of ejecting portions arranged in it, the ink being ejected from the ejecting portions in the print head so that the ejection is not involved in formation of the image, the method comprising the step of:

selecting a set of plural adjacent ones of the plurality of ejecting portion rows as the ejecting portions on which an ejecting operation is simultaneously performed, and switching the set to perform a preliminary ejecting operation of the plurality for ejecting portion rows sequentially.

In the seventh aspect of the present invention, there is provided a preliminary ejecting method executed using an ink jet printing apparatus that forms an image by ejecting ink from a print head including a plurality of large ejecting portion rows in which large ejecting portions are arranged from which a relatively large amount of ink is ejected during one ejecting operation and a plurality of small ejecting portion rows in which small ejecting portions are arranged from which a relatively small amount of ink is ejected during one ejecting operation to a print medium, the ink being ejected from the ejecting portions in the print head so that the ejection is not involved in formation of the image, the method comprising the step of:

if a preliminary ejecting operation relates to the plurality of large ejecting portion rows, simultaneously performing a preliminary ejecting operation on the plurality of large ejecting portion rows; and if a preliminary ejecting operation relates to the plurality of small ejecting portion rows, performing a preliminary ejecting operation on the plurality of small ejecting portion rows one by one.

The above and other objects, effects, features and advantages of the present invention will become more apparent from the following description of embodiments thereof taken in conjunction with the accompanying drawings.

BRIEF DESCRIPTION OF THE DRAWINGS

FIGS. 4A and 4B are views showing an example of a preliminary ejecting process that was examined before implementing the present invention;

FIGS. 6A to 6D are views showing a preliminary ejecting process according to Embodiment 1;

FIGS. 9A to 9E are views showing a preliminary ejecting process according to Embodiment 3.

DETAILED DESCRIPTION OF PREFERRED EMBODIMENTS

Embodiments of the present invention will be described with reference to the drawings.

Figure 1:
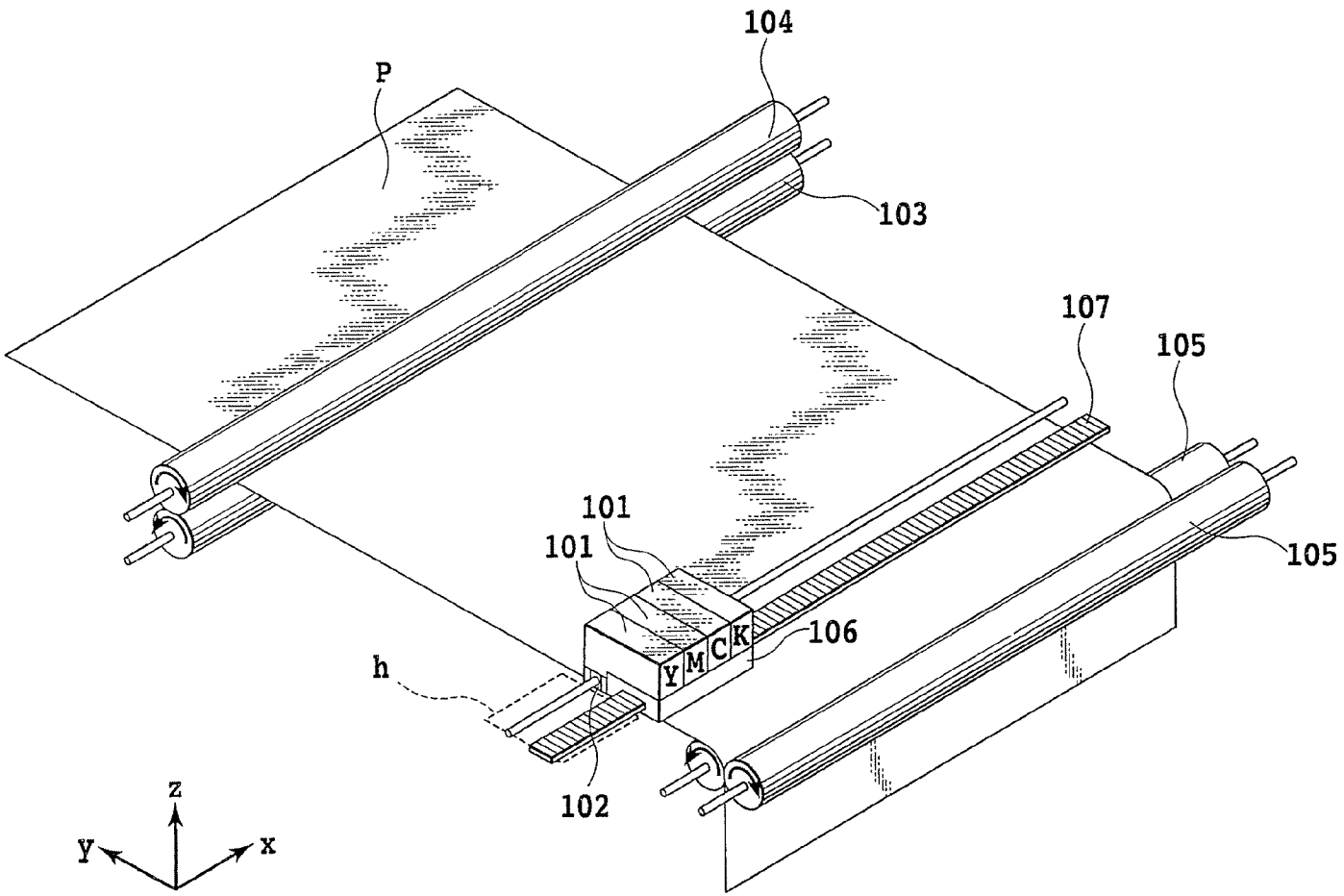
FIG. 1 is a perspective view showing a printing portion of an ink jet printing apparatus as one embodiment of the present invention.

FIG. 1 is a perspective view showing essential parts of an ink jet printing apparatus which are common to the embodiments described below.

In FIG. 1, reference numeral 101 denotes an ink jet cartridge. The ink jet cartridge 101 is composed of an ink tank that stores a black, cyan, magenta, and yellow tanks, and print head 102 having ejection openings row corresponding to the respective inks. The print head 102 will be described later in detail.

Reference numeral 103 denotes a paper feeding roller that rotates in the direction of an arrow in the figure while sandwiching a print medium P between itself and a supplementary roller 104, to convey the print medium in a y direction (subscanning direction) as required. Further, reference numeral 105 denotes a pair of paper feeding roller that feed print media. Like the rollers 103 and 104, the pair of rollers 105 rotate while sandwiching the print medium P between themselves. Further, the print medium can be tensed by reducing the rotation speed of the rollers 105 below the rotation speed of the paper feeding roller 103. Reference numeral 106 denotes a carriage on which the print head are mounted and conveyed and on which four ink jet cartridges 101 are also mounted. Reference numeral 107 denotes a guide rail along which the carriage 106 is scanned over the print medium.

The carriage 106 is scanned from one end to other end of the print medium. Ink is ejected from each print head 102 to the print medium P to print an image. Once the carriage 106 reaches the other end of the print medium P, the paper feeding roller 103 and others are rotated to convey the print medium P by a specified amount. An image is formed all over the print medium by repeating the printing operation and the paper feeding operation.

While no printing operation is performed or before the print head 102 are subjected to a recovery process, the carriage 106 is moved to and stopped at a home position h, shown by a broken line in the figure.

Figure 2:
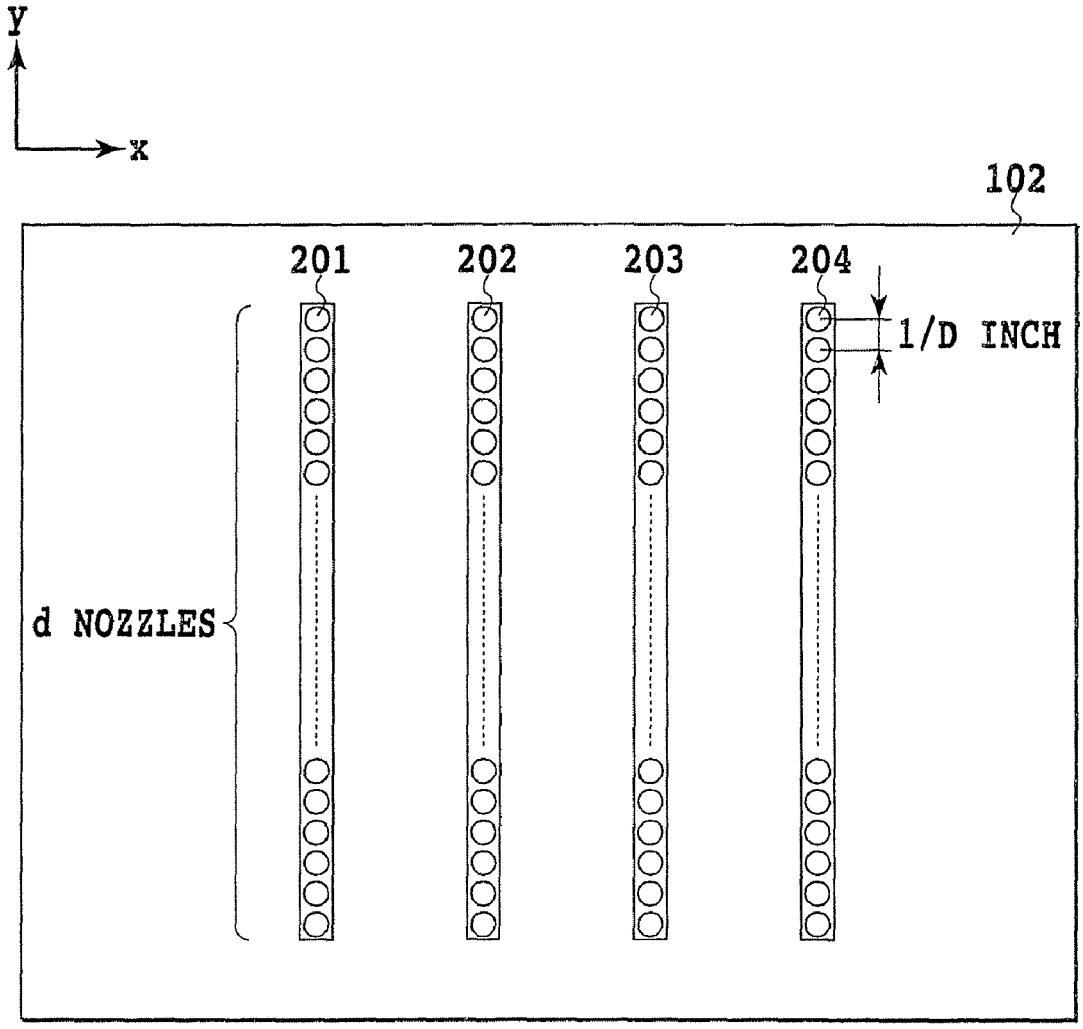
FIG. 2 is a schematic view showing an ejection opening surface of a print head.
Figure 3A:
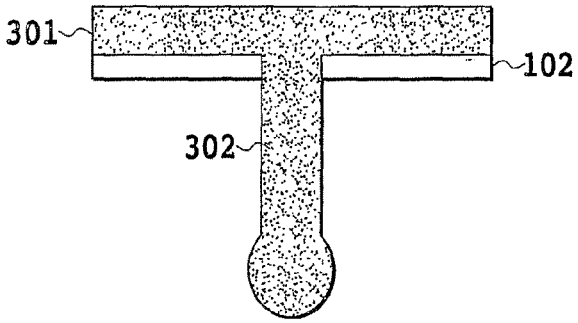
FIGS. 3A to 3C are schematic views showing how ink is ejected as well as satellite droplets and mists.
Figure 3B:
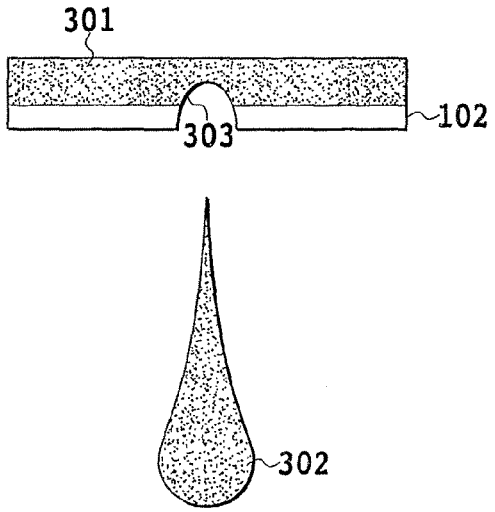
Figure 3C:
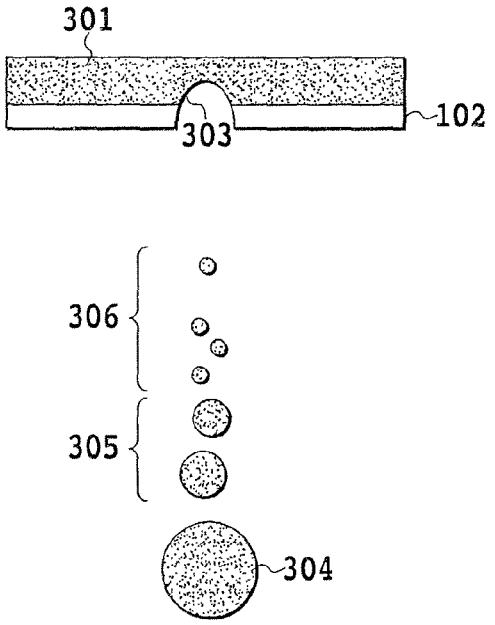

FIG. 2 is a schematic view showing an ejection opening surface of the print head.

The print head 102 has ejecting portion (hereinafter also referred to as "nozzles") for respective colors arranged on its surface lying opposite the print medium. Reference numeral 201 denotes a yellow nozzle row having nozzles arranged at D dpi, i.e. D nozzles per inch and from which yellow ink is ejected. The nozzles are arranged in a direction in which the carriage is scanned, i.e. a y direction, which is perpendicular to the direction of an arrow x. Likewise, reference numeral 202 denotes a nozzle row corresponding to magenta ink. Reference numeral 203 denotes a nozzle row corresponding to cyan ink. Reference numeral 204 denotes a nozzle row corresponding to black ink. These color nozzle rows are arranged in parallel with the carriage scanning direction.

The nozzles are in communication with one another via the corresponding ink tank and ink channel. Accordingly, the vicinity of the ejection opening is always filled with ink supplied by the ink tank. Further, each nozzle is provided with a corresponding heater. Electricity is applied to the heater to generate thermal energy to generate bubbles in the ink. Then, the pressure of the bubbles pushes a predetermined amount of ink out of the nozzle, thus ejecting the ink. In the present embodiment, ink is ejected from the print head on the basis of such a bubble jet (R) method. However, according to the present invention, other ejection methods such as a piezoelectric method may be used to eject ink from the print head. The print head constitute different housings for the respective ink colors or nozzle rows.

Figure 5:
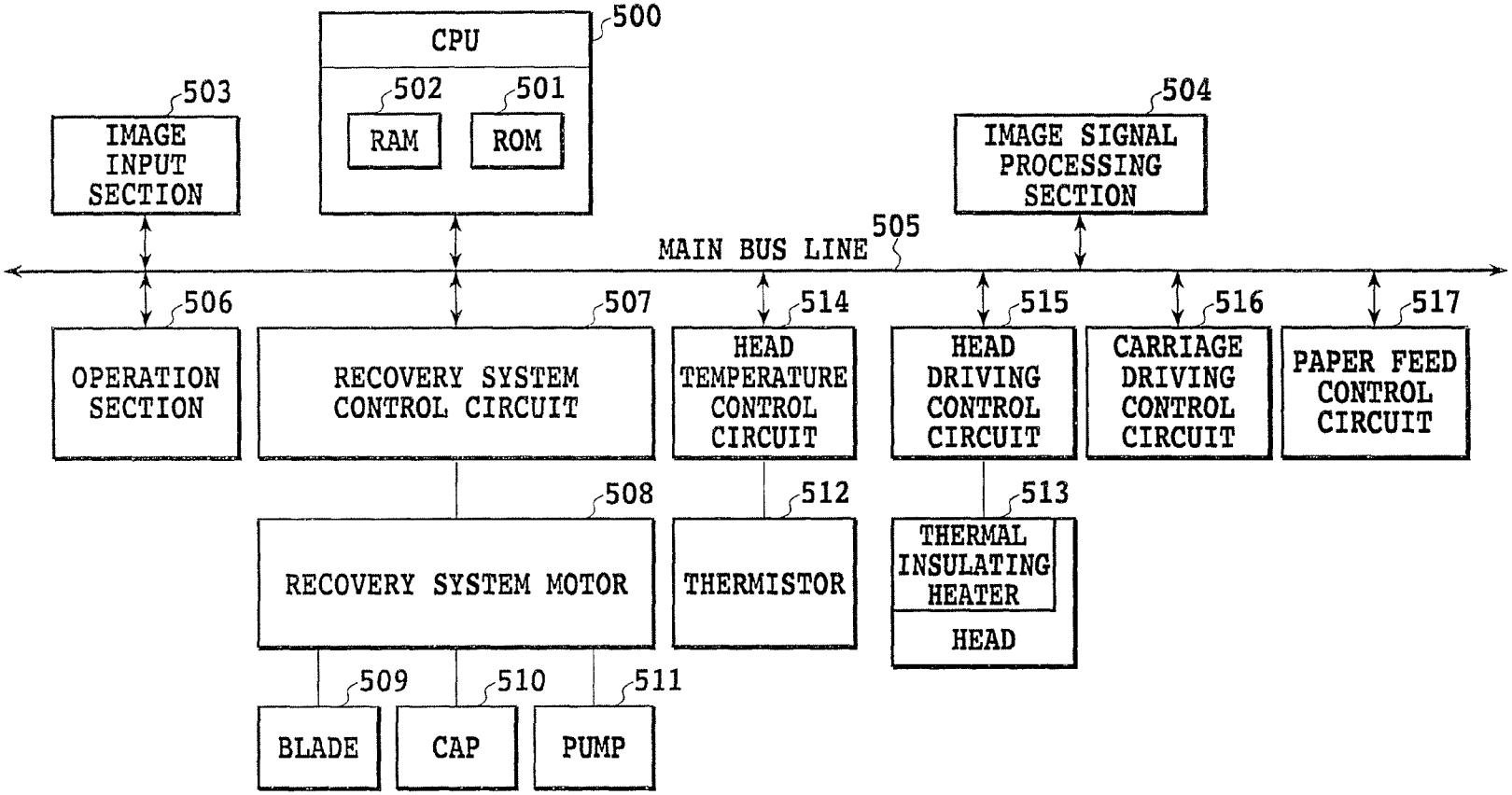
FIG. 5 is a block diagram showing an electric configuration of an ink jet printing apparatus according to an embodiment of the present invention.

FIG. 5 is a block diagram showing a control arrangement of the ink jet printing apparatus according to the present embodiment. The mechanical configuration of the ink jet printing apparatus according to the present embodiment is similar to that shown in FIG. 1.

In FIG. 5, a CPU 500 controls each section of the apparatus and processes data, via a main bus line 505. That is, the CPU 500 controls data processing and head and carriage driving via the sections described below, in accordance with programs stored in a ROM 501. A RAM 502 is used as a work area in which the CPU 500 executes data processing and the like. Further, in addition to these memories, a hard disk and the like are provided as memories. An image input section 503 has an interface to a host apparatus to retain temporarily images inputted by the host apparatus. An image signal processing section 504 executes image processing such as color conversion or binarization.

An operation section 506 comprises keys and the like. This allows an operator to carry out control input and the like. A recovery system control circuit 507 controls a recovery operation such as preliminary ejection in accordance with a recovery process program stored in the RAM 502. Specifically, a recovery system motor 508 drives a print head 513 as well as a cleaning blade 509, a cap 510, and a suction pump 511 arranged opposite and away from the print head 513. Further, a head driving control circuit 515 drivingly controls an ink ejecting electrothermal converter for the print head 513. It also causes the print head 513 to eject ink for preliminary ejection or printing. Furthermore, a carriage driving control circuit 516 and a paper feed control circuit 517 also controls carriage movement and paper feed, respectively, in accordance with relevant programs.

Further, a substrate in which the ink ejecting electrothermal converter in the print head 13 is provided is provided with a thermal insulating heater to increase and adjust the temperature of the ink in the print head to a desired set value. Moreover, a thermistor 512 is also provided in the substrate to measure the substantial temperature of the ink inside the print head. The thermistor 512 may also be provided outside the substrate rather than in it or may be provided around the periphery of or in the vicinity of the print head.

Description will be given below of embodiments of the present invention based on the above apparatus configuration.

A schematic view of the print head used in the present embodiment is similar to FIG. 2.

The black and color nozzle rows each have 128 ejection openings (nozzles) arranged at a nozzle pitch of about 42.4 μm. The print head is 5.42 mm in length. Further, in the x direction, the black nozzle row 204 is located upstream (a print area side), whereas the yellow nozzle row 201 is located downstream (a home position side). The distance between the black nozzle row 204 and the yellow nozzle row 201 is 3.0 mm. Further, there is an equal distance of 1.0 mm between the yellow and magenta nozzle rows, between the magenta and cyan nozzle rows, and between the cyan and black nozzle rows.

On the other hand, a preliminary ejection receiver provided at the home position has a width of 5.0 mm. Thus, the yellow, magenta, cyan, and black nozzle rows can be subjected to preliminary ejection without being moved, i.e. without the need to move the carriage. By carrying out preliminary ejection while the carriage is stopped, mists are prevented from flying into the apparatus.

According to the present embodiment, in order to prevent generated mists from whirling up, preliminary ejection is carried out while the carriage on which the print head are mounted is not performing a scanning operation. Further, all the ink color nozzles are not simultaneously undergo preliminary ejection but they sequentially undergo preliminary ejection through a plurality of steps. Furthermore, for each step, nozzle rows subjected to preliminary ejection are selected on the basis of predetermined conditions described below.

(Examinations Made Before Implementing the Invention)

FIGS. 4A and 4B show a preliminary ejecting operation divided into a plurality of steps. Reference numeral 401 denotes a preliminary ejection receiver that receives ink droplets ejected from the printhead 102. Reference numeral 402 denotes a track of an ink droplet resulting from yellow preliminary ejection. Reference numeral 403 denotes a track of an ink droplet resulting from magenta preliminary ejection. Reference numeral 404 denotes a track of an ink droplet resulting from cyan preliminary ejection. Reference numeral 405 denotes a track of an ink droplet resulting from black preliminary ejection. Reference numeral 406 denotes tracks of a floating mist and are bounding mist (a fine ink droplet formed when an ink droplet impacts the preliminary ejection receiver and then rebounds) as they are whirled up by an air current resulting from the preliminary ejection. Both the floating mist and rebounding mist will hereinafter simply referred to as a "mist". In the preliminary ejecting operation shown in FIGS. 4A and 4B, the nozzle rows 201 to 204 corresponding to the four types of ink are divided into two groups each of two nozzle rows so that a preliminary ejecting operation is performed on each group.

FIG. 4A represents the first step of preliminary ejection divided into two steps. Preliminary ejections 403 and 404 corresponding to magenta and cyan are carried out. An ink droplet from the magenta preliminary ejection 403 impacts the preliminary ejection receiver 401. At the same time, the mists 406 are generated. The resulting air current whirls up the mists 406. Similarly, when an ink droplet from the cyan preliminary ejection 404 impacts the preliminary ejection receiver 401, the resulting air current whirls up the mists 406. Rebounding air currents collide against each other which result from the impact of ink droplets from the preliminary ejections 403 and 404 corresponding to magenta and cyan. Thus, the mists 406 are further whirled up toward the print head 102. However, almost all the whirled-up mists are pushed back by the air currents 403 and 404 caused by the succeeding magenta and cyan preliminary ejections. As a result, few mists 406 reach the print head 102, notably the positions at which the ejection openings (nozzles) are disposed. It is needless to say that few mists enter the nozzles in the magenta and cyan nozzle rows 202 and 203.

FIG. 4B represents the second step of the preliminary ejection divided into the two steps. After the cyan and magenta preliminary ejections (first step) have been finished, the preliminary ejections 402 and 405 corresponding to yellow and black are carried out. The preliminary ejections 402 and 405 corresponding to yellow and black similarly whirl up the mists 406. However, the distance of the nozzle rows between the yellow and black is larger than that between the magenta and cyan. Accordingly, air currents caused by the succeeding yellow and black ejections and flowing toward the preliminary ejection receiver do not sufficiently reach the whirled-up mists. As a result, the whirled-up mists are not pushed back but reach a surface of the printhead 102. The arriving yellow and black mists stick to the surface of the print head 102 near the nozzle rows 202 and 203 corresponding to magenta and cyan. When the sticking mists enter the magenta and cyan nozzles, the ink colors may be mixed together.

As described above, if a plurality of nozzle rows are arranged in the main scanning direction and are subjected to preliminary ejection using a plurality of steps, whirled-up mists may stick to the surface of the print head depending on the selection of nozzle rows on which preliminary ejection is executed during one step. Then, color mixture may occur between the sticking mists and the ink in the nozzles to affect images. For example, the desired colors cannot be printed during the succeeding printing operation. Further, if the mist sticking to any nozzle has the same color as the ink ejected from the nozzle, the color mixture does not occur. However, since the ink sticks to the surface of the nozzle, it is likely that ink is not ejected in the correct direction during the succeeding ejecting operation. These problems are more likely to occur when there is a predetermined or larger distance between nozzle rows simultaneously subjected to preliminary ejection. To avoid this situation, it is contemplated that all the nozzle rows may simultaneously undergo preliminary ejection. However, to subject simultaneously all the nozzle rows to preliminary ejection, the ink jet printing apparatus main body must be provided with a high-power power source. This increases costs.

The present invention is provided in view of the above described problems. Some embodiments of the present invention will be described below.

Embodiment 1

FIGS. 6A to 6D show the order of preliminary ejection wherein the preliminary ejection is divided into four steps according to the present embodiment.

In the present embodiment, preliminary ejection is carried out for each nozzle row while the carriage on which the print head are mounted is not performing a scanning operation. Further, a nozzle row subjected to preliminary ejection is sequentially selected starting with the yellow one located at an end of the print head. In FIGS. 6A to 6D, reference numerals 201 to 204 and 401 to 406 denote the same elements as those shown in FIG. 4 and having the same reference numerals.

FIG. 6A is a schematic view showing the first step of preliminary ejection divided into four steps. In the first step, only the yellow nozzle row is subjected to the preliminary ejection 402. This preliminary ejection causes an air current over the preliminary ejection receiver. Then, the mists 406 are whirled up. However, since only the yellow nozzle row is undergoing preliminary ejection, the air current does not collide against any preliminary ejections from the other color nozzle rows as shown in FIG. 4. Accordingly, the whirled-up mists 406 do not have a sufficient rising force to reach the surfaces of the print head 102. Consequently, few mists reach the surfaces of the print head 102, with most mists flown in the x direction.

Similarly, in the second step, the magenta nozzle row is subjected to preliminary ejection (see FIG. 6B). In the third step, the cyan nozzle row is subjected to preliminary ejection (see FIG. 6C). In the fourth step, the black nozzle row is subjected to preliminary ejection (see FIG. 6D). In each of the second to fourth steps, two or more different nozzle rows do not simultaneously perform an ejecting operation. Accordingly, only one nozzle row performs an ejecting operation during each step. Consequently, the preliminary ejection does not cause air currents to collide against each other. Few mists reach the surfaces of the print head 102.

As described above, in an ink jet printing apparatus comprising a plurality of nozzle rows arranged in the main scanning direction and having a plurality of preliminary ejecting steps, when only one nozzle row is subjected to preliminary ejection during each step, no mists stick to the surfaces of the print head. This provides an ink jet printing apparatus that can print desired colors without causing ink color mixture.

Embodiment 2

The print head used in the present embodiment are similar to the print head in FIG. 2 which are used in Embodiment 1.

In the description of Embodiment 1, preliminary ejection is executed on one nozzle row during each step. However, compared to the simultaneous preliminary ejection of all the nozzle rows, Embodiment 1 requires a quadruple period of time (four steps) to subject all the nozzle rows to preliminary ejection. In the present embodiment, description will be given of the case in which preliminary ejection is carried out through two steps in order to reduce the time required for the preliminary ejection.

Figure 7A:
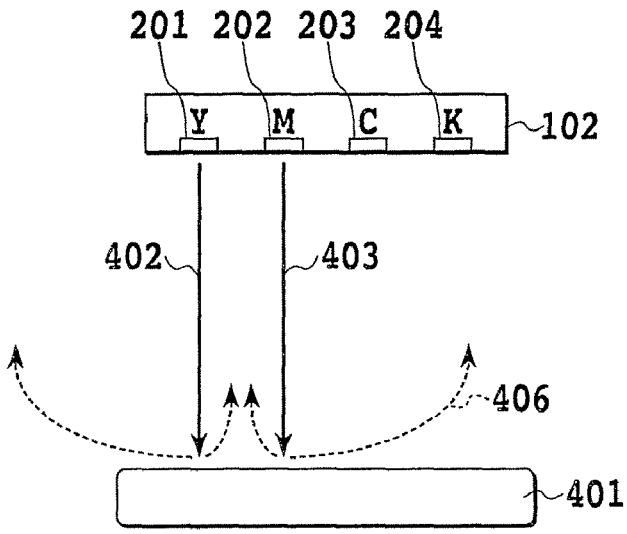
FIGS. 7A and 7B are views showing a preliminary ejecting process according to Embodiment 2.
Figure 7B:
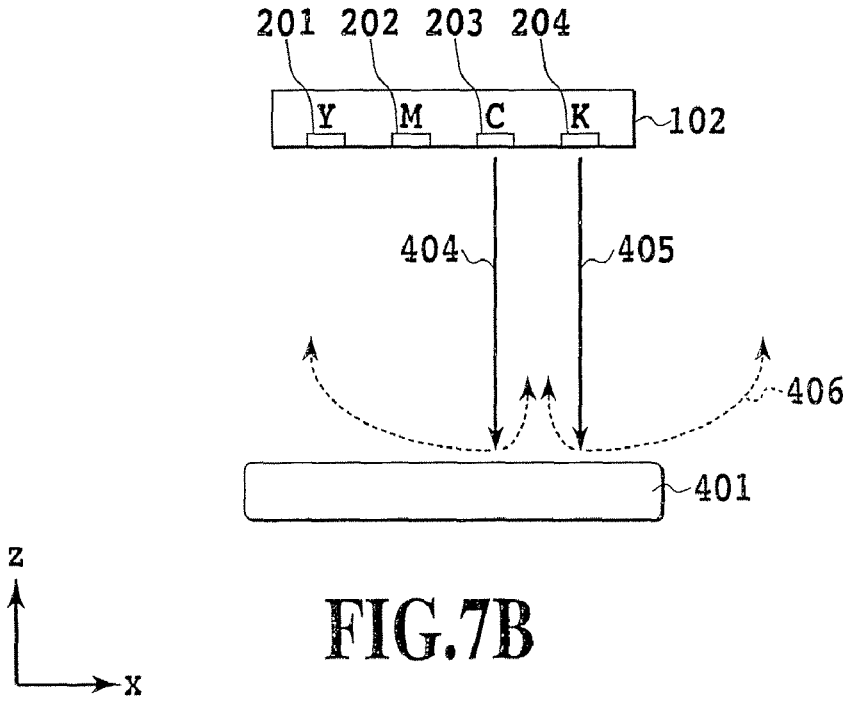

FIGS. 7A and 7B show the order of preliminary ejection wherein the preliminary ejection is divided into two steps according to the present embodiment.

FIG. 7A is a schematic view showing preliminary ejection in the first step of preliminary ejection divided into two steps.

In the first step, the adjacent yellow and magenta nozzle rows are subjected to the preliminary ejections 402 and 403, respectively. The preliminary ejections to the preliminary ejection receiver 401 cause air currents to whirl up the mists 406. Furthermore, since the two nozzle rows are simultaneously undergoing preliminary ejection, both air currents collide against each other. Consequently, the mists 406 are whirled up and have a sufficient force to reach the surfaces of the print head. However, as described in FIG. 4A, most whirled-up mists 406 are pushed back by the succeeding preliminary ejection from the magenta and cyan nozzle rows and do not reach the print head. A few mists reach the print head but few of them enter the nozzles in the magenta and cyan nozzle rows. This prevents ink color mixture that may result from the arrival of mists at the surfaces of the print head.

Similarly, in the second step, shown in FIG. 7B, the adjacent cyan and black nozzle rows are subjected to preliminary ejection. Then, mists are whirled up. However, the mists whirled up during the last preliminary ejection are pushed back by air currents caused by the preliminary ejections from the cyan and black nozzle rows and flowing toward the preliminary ejection receiver. Consequently, few mists reach the print head.

In the present embodiment, preliminary ejection is carried out through two steps. That is, the two nozzle rows from the downstream end of the print head in the x direction undergo preliminary ejection during the first step. Then, the two nozzle rows from the upstream end of the print head in the x direction undergo preliminary ejection during the second step. In this case, similar effects can also be produced by the two-step preliminary ejection described below. The three nozzle rows from the downstream end of the print head in the x direction undergo preliminary ejection during the first step. Then, the one nozzle rows from the upstream end of the print head in the x direction undergo preliminary ejection during the second step.

The phenomenon in which mists are pushed back by air currents caused by preliminary ejections and flowing toward the preliminary ejection receiver occurs only if the distance between the nozzle rows is appropriately short. Consequently, this phenomenon is likely to occur between the adjacent nozzle rows. In order to push back mists reliably, it is necessary to set an appropriate ink flying speed for an ejecting operation. Thus, the inventors have experimentally determined an ink flying speed effective in pushing back mists and a driving frequency required to achieve the flying speed. The flying speed and the driving frequency vary depending on the amount of ink ejected, the distance between the nozzle rows, the nozzle pitch, or the like. Thus, they are determined through experiments or the like as required.

As described above, in an ink jet printing apparatus comprising a plurality of nozzle rows arranged in the main scanning direction and having two preliminary ejecting steps, the plurality of nozzle rows are divided into two groups adjacently spaced nozzle rows in the main scanning direction. When the two groups are sequentially subjected to preliminary ejection, no mists stick to the surfaces of the print head. This provides an ink jet printing apparatus that can print desired colors without causing ink color mixture.

In the present embodiment, an example has been described in which each of two sets of nozzle rows is made from adjacent two nozzle rows and the two sets of nozzle rows are sequentially selected to be subjected to preliminary ejection. However, the present invention is not limited to this aspect. All the nozzle rows may be divided into sets each of a plurality of adjacent nozzle rows, e.g. six nozzle rows may be divided into two sets, i.e. three adjacent rows and one row, so that a preliminary ejecting operation can be sequentially performed on these sets.

Embodiment 3

In the description of Embodiments 1 and 2, a specified amount of ink is ejected from each print head. In the description of the present embodiment, each print head has nozzles from which different amounts of ink are ejected (large and small dots).

Figure 8:
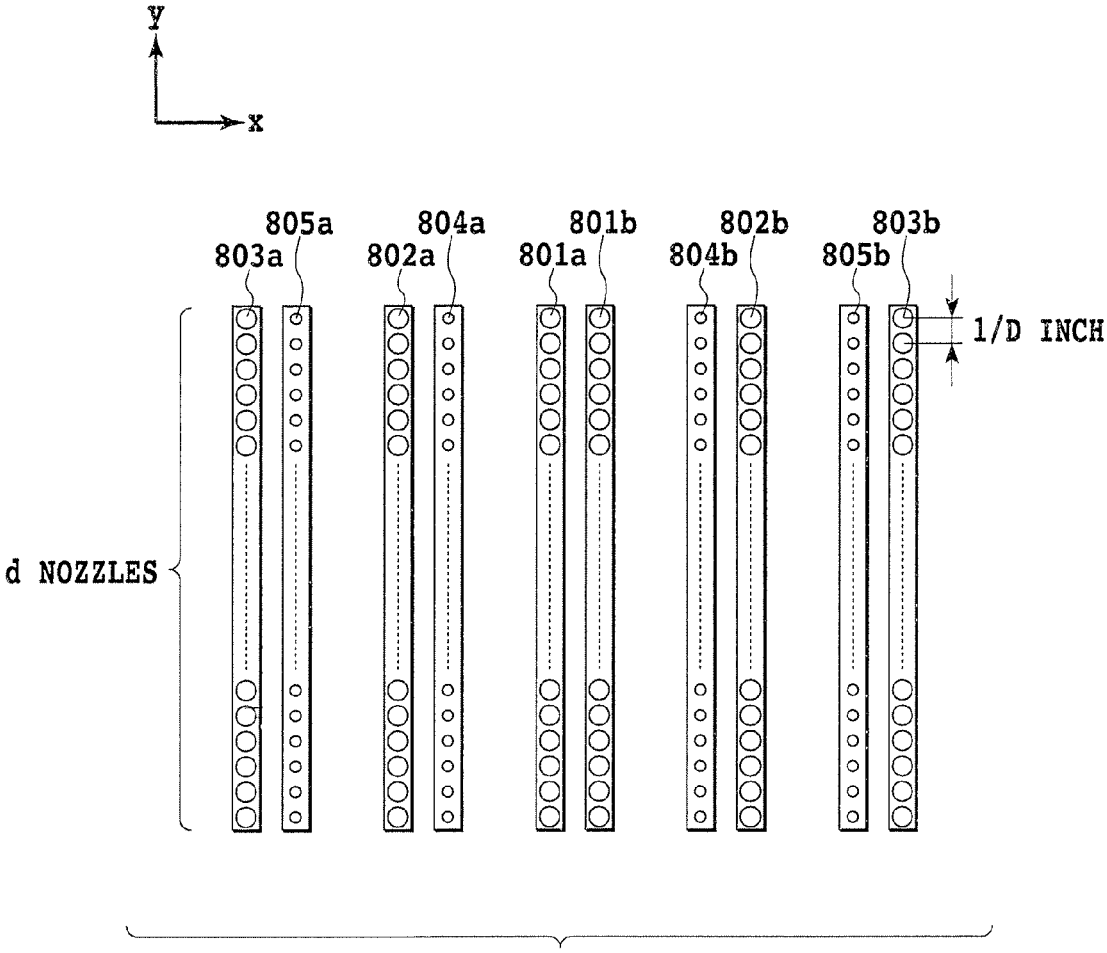
FIG. 8 is a schematic view showing an ejection opening surface of a print head according to Embodiment 3.

In FIG. 8, reference numeral 801 denotes nozzle rows from which yellow large dots are ejected. Reference numerals 802 and 803 denote nozzle rows from which magenta and cyan large dots, respectively, are ejected. Reference numeral 804 denotes nozzle rows from which magenta small dots are ejected. Reference numeral 805 denotes nozzle rows from which cyan small dots are ejected. The distance between the two nozzle rows from which yellow large dots are ejected is 0.3 mm. Between the nozzle rows 803 and the nozzle rows 802 and between the nozzle rows 802 and the nozzle rows 801, the distance between the nozzle rows from which large dots are ejected is 1.0 mm. That is, the distance is 1.0 mm or less in all the cases. There is a distance of 0.3 mm between the nozzle row from which small dots 804 are ejected and the adjacent nozzle row from which large dots 802 of the same color are ejected. Further, the nozzle rows are laterally symmetric with respect to the central yellow ink. For a distinction, the nozzle rows in the left are denoted by the subscript "a", while the nozzle rows in the right are denoted by the subscript "b". The present embodiment does not use any black nozzle rows.

When the size of ink droplets resulting from the ejection of large dots and which are different from main droplets is compared to that of ink droplets resulting from the ejection of small dots and which are different from main droplets, the latter ink droplets are smaller and are thus more easily whirled up by air currents. Specifically, when large and small dots are ejected, more mists result from the small dots than from the large dots. Consequently, more mists reach the surfaces of the print head.

In order to prevent surely mists from reaching the surfaces of the print head whether the dots are large or small, it is also effective in the present embodiment to provide as many preliminary ejecting steps as the nozzle rows and to execute preliminary ejection on one nozzle row at a time. However, the print head used in the present embodiment has the ten nozzle rows. Accordingly, if preliminary ejection is executed on one nozzle row at a time, it is necessary to provide a period of time that is ten times as long as that required for the preliminary ejection from all the nozzle rows. Thus, in order to reduce the time required for preliminary ejection and prevent surely mists from reaching the surfaces of the print head, the present embodiment carries out preliminary ejection taking into account the amount of mists resulting from the ejection of large and small dots.

FIGS. 9A to 9E show the order of preliminary ejection wherein the preliminary ejection is divided into five steps according to the present embodiment.

In FIGS. 9A to 9E, reference numerals 901, 902, and 903 denote tracks of preliminary ejections from the large dot nozzle rows for yellow, magenta, and cyan. Reference numerals 905 and 908 denote tracks of preliminary ejections from the small dot nozzle rows for cyan. Reference numerals 906 and 907 denote tracks of preliminary ejections from the small dot nozzle rows for magenta. Reference numeral 909 denotes tracks of mists whirled up by air currents resulting from preliminary ejections from the large dot nozzle rows for the respective color inks.

FIG. 9A is a schematic view representing the preliminary ejection in the first step of preliminary ejection divided into five steps.

In the first step, all the large dot nozzle rows undergo preliminary ejection. The large dot nozzle row for each ink is adjacent to the small dot nozzle row for this color except for yellow. Furthermore, the distance between the large dot nozzle row for each ink and the closest large dot nozzle row is 1.0 mm or less as described above. During preliminary ejection, air currents occur to whirl up mists. Furthermore, the mists collide against air currents resulting from the simultaneous ejections from the other nozzle rows and are whirled up toward the surfaces of the print head. However, the distance between the nozzle rows on which an ejecting operation is simultaneously performed is short, specifically 1.0 mm. Accordingly, for example mists generated between the cyan and magenta nozzle rows and between the magenta and yellow nozzle rows are pushed back by air currents resulting from the succeeding preliminary ejection and flowing toward the preliminary ejection receiver. Further, the mists generated are fewer than those generated together with ink droplets for small dots. Furthermore, the size of the ink droplets resulting in the mists are small. Thus, only a few mists are whirled up by air currents, with few of these mists reaching the surfaces of the print head.

Further, after the first step, it is possible in connection with power to subject all the small dot nozzle rows to preliminary ejection during the second step. However, for the yellow ink, both the nozzle rows 801*a* and 801*b* provide large dots. There are no small dot nozzle rows for this ink. The distance between the small dot nozzle rows for magenta 804*a* and 804*b* is larger than 1.0 mm. Consequently, mists whirled up between these nozzle rows are likely to reach the yellow nozzle rows 801 without being pushed back by air currents resulting from the succeeding preliminary ejection and flowing toward the preliminary ejection receiver. Thus, the present embodiment is composed of four steps in which the small dot nozzle rows undergoes preliminary ejection one by one.

As shown in FIG. 9B, first, preliminary ejection is executed only on the small dot nozzle row for cyan 805*a*. Since no other nozzle rows are subjected to preliminary ejection, mists are prevented from being whirled up owing to a synergistic effect. Consequently, mists 910 fall onto the preliminary ejection receiver without reaching the surfaces of the print head 102.

Then, similarly, preliminary ejection is executed only on the small dot nozzle row for magenta 804*a* (see FIG. 9C). Then, preliminary ejection is executed only on the small dot nozzle row for magenta 804*b* (see FIG. 9D). Finally, preliminary ejection is executed only on the small dot nozzle row for cyan 805*b* (see FIG. 9E). Since a single nozzle row undergoes preliminary ejection in all the steps, the mists 910 are prevented from being whirled up. Consequently, few mists reach the surfaces of the print head.

As described above, in an ink jet printing apparatus comprising a plurality of nozzle rows arranged in the main scanning direction and having a plurality of preliminary ejecting steps, preliminary ejection is executed, during one step, on all the nozzle rows from which large dots are ejected. On the other hand, the nozzle rows from which small dots are ejected undergo preliminary ejection one by one. Then, no mists stick to the surfaces of the print head. This provides an ink jet printing apparatus that can print desired colors without causing ink color mixture.

In Embodiments 1 to 3, if the distance between two nozzle rows simultaneously undergoing preliminary ejection is 1.0 mm or less, mists whirled up by the collision of two air currents can be pushed back by air currents resulting from the succeeding preliminary ejection and flowing toward the preliminary ejection receiver. However, if the distance between the nozzle rows is larger than 1.0 mm, mists are more likely to reach the surfaces of the print head without being pushed back. These are values experimentally obtained by the inventors. Further, it is assumed that these values vary depending on the length of the nozzle rows and the flying speed of preliminary ejection.

However, if the distance between the two adjacent nozzle rows is larger than 1.0 mm and mists generated are insufficiently pushed back, then a large number of mists stick to an area midway between the two nozzle rows on the surfaces of the corresponding print head. When there are no nozzles are located in this area, even if mists sticks to it, problems such as color mixture do not occur. Regardless of the intervals at which the nozzle rows are arranged, the simultaneous preliminary ejection from the two adjacent nozzle rows according to Embodiments 2 and 3 is effective in preventing color mixture caused by mists. Further, with the sequential preliminary ejection from each nozzle row according to Embodiment 1, mists are prevented from being whirled up. Therefore, this means is effective regardless of the distance between the nozzle rows.

As described above, according to the present invention, if a force of mists resulting from an ink ejecting operation which causes the mists to move toward the nozzle surfaces of the print head is not sufficient to cause the mists to reach the nozzle surfaces or the mists are pushed back by air currents resulting from the succeeding preliminary ejecting operation, most mists generated move so as not to reach the nozzle surfaces or fall toward the preliminary ejection receiver. This prevents the mists from sticking to the nozzle surfaces. It is also possible to prevent color mixture caused by sticking ink flowing into the nozzles. Consequently, it is possible to prevent the degradation of images caused by color mixture. Moreover, the number of nozzle rows on which an ejection operation is simultaneously performed is limited. Accordingly, the power consumption required for preliminary ejection can be limited to within the possible range of supplied power. This provides an inexpensive apparatus.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink jet printing apparatus comprising:

a print head including a plurality of large ejecting portion rows in which large ejecting portions are arranged from which a relatively large amount of ink is ejected during one ejecting operation and a plurality of small ejecting portion rows in which small ejecting portions are arranged from which a relatively small amount of ink is ejected during one ejecting operation;

preliminary ejecting means for ejecting the ink from the large and small ejecting portions in said print head so that the ejection is not involved in formation of an image; and preliminary ejecting control means for simultaneously performing a preliminary ejecting operation on the plurality of large ejecting portion rows, and for performing a preliminary ejecting operation on the plurality of small ejecting portion rows one by one.

2. A ink jet printing apparatus according to claim 1, wherein said preliminary ejecting control means performs the preliminary ejecting operation for the small ejecting portion rows after performing the preliminary ejecting operation for the large ejecting portion rows.

3. An ink jet printing apparatus according to claim 1, wherein, in said print head, an ejecting portion row in which ejection amount is relatively large and an ejecting portion row in which ejection amount is relatively small are alternately arranged and symmetrically disposed, in a scanning direction, on both sides of ejecting portion rows in which ejection amount is relatively large.

4. A method for controlling an ink jet printing apparatus that performs printing by using a print head including a first plurality of ejecting portion rows in which ejecting portions are arranged from which a relatively large amount of ink is ejected during one ejecting operation and a second plurality of ejecting portion rows in which ejecting portions are arranged from which a relatively small amount of ink is ejected during one ejecting operation, the method comprising the steps of:

simultaneously performing a preliminary ejecting operation on the first plurality of ejecting portion rows in which ejection amount is relatively large; and performing a preliminary ejecting operation on the second plurality of ejecting portion rows in which ejection amount is relatively small, one by one.

* * * * *